United States Patent [19]

Gregg

[11] 4,345,536

[45] Aug. 24, 1982

[54] VESSEL RAISING HEAVY STRUCTURES

[76] Inventor: F. Browne Gregg, P.O. Box 1046, Leesburg, Fla. 32748

[21] Appl. No.: 89,663

[22] Filed: Oct. 30, 1979

[51] Int. Cl.[3] ..... B63B 39/02

[52] U.S. Cl. ..... 114/124; 114/260; 414/137; 14/1

[58] Field of Search ..... 114/26, 27, 31, 34, 114/124, 61, 121, 125, 44, 45, 259, 260; 414/137; 405/196, 205, 209; 14/1, 73

[56] References Cited

U.S. PATENT DOCUMENTS

| | | | |
|---|---|---|---|
| 652,243 | 6/1900 | Brown | 114/125 |
| 2,200,661 | 5/1940 | Templeton | 114/27 |
| 2,347,412 | 4/1944 | Higgins | 114/259 |
| 2,627,355 | 2/1953 | Munro | 114/27 |
| 3,011,319 | 12/1961 | Ganzenmuller | 414/137 |
| 3,057,315 | 10/1962 | Robishaw | 114/26 |
| 3,318,276 | 5/1967 | Nemec | 114/260 |
| 3,537,600 | 11/1970 | Schuchmann | 414/137 |
| 3,687,307 | 8/1972 | Macrander et al. | 414/137 |
| 3,704,796 | 12/1972 | Dedons et al. | 414/137 |
| 3,835,800 | 9/1974 | Lloyd et al. | 114/265 R |
| 3,882,564 | 5/1975 | Muller | 14/1 |
| 3,931,778 | 1/1976 | Miller et al. | 114/26 |
| 3,937,027 | 2/1976 | Koehler et al. | 414/137 |
| 3,977,346 | 8/1976 | Natvig et al. | 114/65 R |
| 3,993,011 | 11/1976 | Garland | 114/140 |

FOREIGN PATENT DOCUMENTS

| | | | |
|---|---|---|---|
| 22039 | 3/1928 | Netherlands | 114/259 |

*Primary Examiner*—Robert J. Spar
*Assistant Examiner*—Kenneth Noland
*Attorney, Agent, or Firm*—Dowell & Dowell

[57] ABSTRACT

A floating vessel having a pair of inclined tracks on which one or more carriages are movably mounted and such vessel has a plurality of compartments or tanks which may be selectively flooded or pumped dry to control the trim of the vessel. When the forward tanks are flooded, the bow portion of the vessel is partially submerged and at least a portion of the carriage may be disposed under water in a position to receive a heavy floating object, after which the tanks may be emptied and the carriages raised along the rails so that the object is removed from the water and moved to a desired height.

13 Claims, 14 Drawing Figures

VESSEL RAISING HEAVY STRUCTURES

SUMMARY OF THE INVENTION

In the past, bridges have been built by constructing piers or pilings in appropriate spaced relationship with each other, usually approximately 60 feet (18.29 meters) apart, after which the bridge deck unit was constructed at the site. In order to reduce the labor involved and thereby reduce the cost of the structure, precast sections of the bridge or bridge deck units have been constructed in a location remote from the piers and moved to the site by barge or by sealing the ends of the sections and floating the sections to the site. At the site, a large crane-type barge has been used to lift the bridge sections onto the piers. At the present time such crane-type barges cost approximately $25 million and their usefulness is limited since they are unable to function in water less than approximately 10 feet (3.06 meters) in depth without extensive dredging. After a bridge has been in service for an extended period, it becomes necessary to repair or replace the bridge sections. In order to replace such sections, it has been necessary to remove the old section before a replacement section could be added and the crane-type barge has been used for this purpose.

It is desirable to reduce the necessity of the crane-type barge due to the expense involved and some political subdivisions, such as the State of Florida, have agreed to accept smaller precast bridge sections including sections having a length of approximately 12 feet (3.66 meters) which may be joined together at the site. These sections may be moved into position and assembled by smaller derricks by placing a pair of sections on a pier and then on alternate sides for balance. This type of construction also has required substantial labor and expense.

The vessel of the present invention has utility in raising boats, barges, scows and other heavy objects out of the water, as well as from the surfaces of docks, wharves, barges and other structures on or near the water and is especially useful in the building and repairing of bridges which span both shallow and deep water. Such vessel can be constructed for a fraction of the cost of a crane-type barge but can handle heavy elongated objects such as precast bridge sections of from 60 feet (18.29 meters) to 120 feet (36.58 meters) in length and can handle a weight of approximately 500 short tones (453.6 metric tons) while drawing approximately 4 feet (1.22 meters) of water.

The vessel includes a bifurcated hull having a pair of longitudinally inclined tracks on each of which a carriage is movably mounted. Such hull is provided with a plurality of compartments or tanks which may be fully or partially flooded or pumped dry selectively, to control the trim of the vessel. When the forward compartments are flooded, the carriages may be moved down the inclined tracks to permit the carriages to be disposed beneath a heavy object which may be floating in the water or may be supported above the surface thereof. When the carriages are located beneath the object, water is pumped from the forward compartments to raise the bow of the vessel until the spaced carriages engage and support the object. Thereafter the carriages may be moved along the inclined track to raise the object out of the water or to lift the object from a pier, barge or other structure and to locate the object at a predetermined elevation. The bow portion of the vessel is bifurcated so that when the vessel raises a bridge unit, such vessel may be moved to a bridge pier and such pier is received between the bifurcations of the vessel, so that the vessel may place the preformed bridge unit on top of one or more piers.

It is an object of the invention to provide a marine vessel having means for raising heavy objects from the water or from a structure located adjacent to the water and in which such vessel has a plurality of watertight compartments or ballast tanks which may be selectively filled and emptied to control the trim of the vessel and thereby assist in raising the heavy object.

Another object of the invention is to provide a marine vessel having inclined tracks on which one or more carriages are movably mounted and such carriages are adapted to engage and lift a floating bridge unit from the water and place such bridge unit on a piling at a predetermined height above the water line.

A further object of the invention is to provide a marine vessel which is simple and inexpensive to build and maintain and which can raise relatively heavy floating objects from a first position and carry such objects to a second position.

DESCRIPTION OF THE PREFERRED EMBODIMENTS

Figure 1:
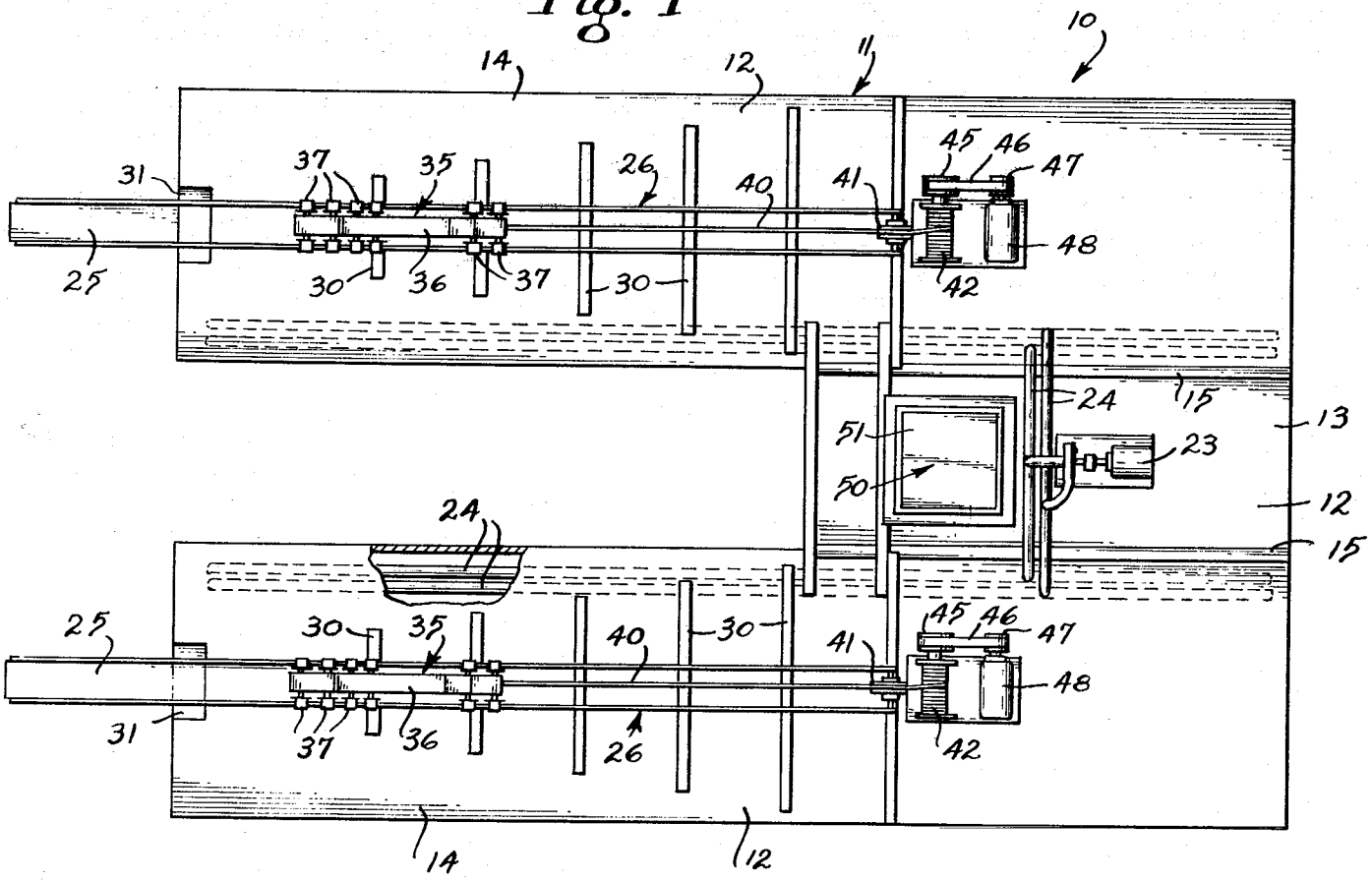
FIG. 1 is a top plan view illustrating one embodiment of the marine vessel of the present invention.
Figure 2:
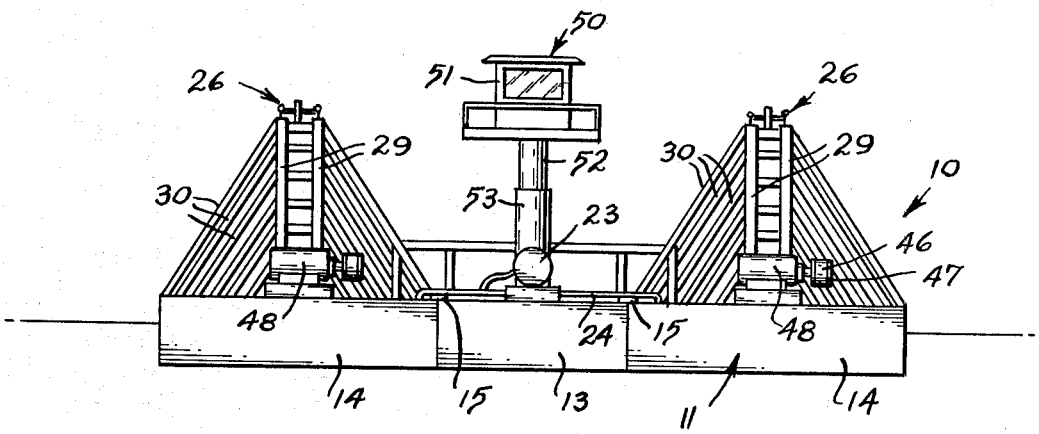
FIG. 2 is a rear end elevational view thereof.

With continued reference to the drawings, a vessel 10 is provided having a hull 11 with a main deck 12 and such hull preferably is bifurcated and is provided with a central portion 13 and a pair of outboard portions or bifurcations 14. If desired, the hull 11 may be constructed as an integral unit or, if desired, such hull may be constructed as three independent units which are secured together in any desired manner, as by welding or the like. As shown best in FIGS. 1 and 2, when the hull is constructed of several units, the joints between the central portion 13 and the outboard portions 14 may be welded together by a connector plate 15.

Each of the outboard portions of the hull is provided with a plurality of watertight bulkheads 16 which separate the outboard portions of the hull into a plurality of watertight tanks or compartments 17, 18, 19, 20, 21 and 22, numbered from the bow to the stern. The compartments 17–22 may be selectively flooded or evacuated of water in any desired manner so as to control the trim of the vessel 10. As illustrated, a ballast pump 23 is mounted on the main deck 12 of the central portion 13 and is connected by appropriate piping 24 and control valves (not shown) for permitting water to be introduced into one or more selected compartments or removed therefrom.

It is contemplated that each of the compartments could have a selectively operated remotely controlled seacock which, when open, permits water to enter the compartment. In this case, the ballast pump could supply air under pressure to a selected compartment to force the water out of the compartment through a vent (not shown). Also it is contemplated that the ballast pump could draw water from the body of water surrounding the vessel and pipe such water to the appropriate compartments in order to fill such compartments. When it is desired to remove the water from the compartments, such water may be removed through the same pipes by operating appropriate valves in a conventional manner (not shown) so that the water from the compartments is exhausted to the body of water. Also, it is contemplated that the water may be removed from one or more selected compartments and transferred to other compartments by operating the pump 23 and appropriate valves.

With particular reference to FIGS. 1 and 3–6, a forwardly extending support member 25 is attached to the vessel adjacent to the bow of each of the outboard portions and extends forwardly thereof a substantial distance. An inclined track 26 is mounted longitudinally of each of the outboard portions 14 and each track includes a pair of spaced generally parallel rails 27 which are welded or otherwise attached to longitudinally extending beams 28. Each of the beams 28 is supported at spaced intervals along its length by upright posts 29 and preferably a plurality of struts or buttress members 30 provide lateral support for such beams.

Adjacent to the bow of the vessel the beams 28 extend through a recess or inclined portion 31 on the upper deck and the forward ends of such beams are connected to the forwardly extending support members 25. With this arrangement the forward lower ends of the beams 28 and rails 27 are disposed below the water line of the vessel and are inclined upwardly to a substantial height abaft the beam of the vessel. The forward portion of each of the rails 27 is provided with a bumper or stop member 32.

Figure 7:
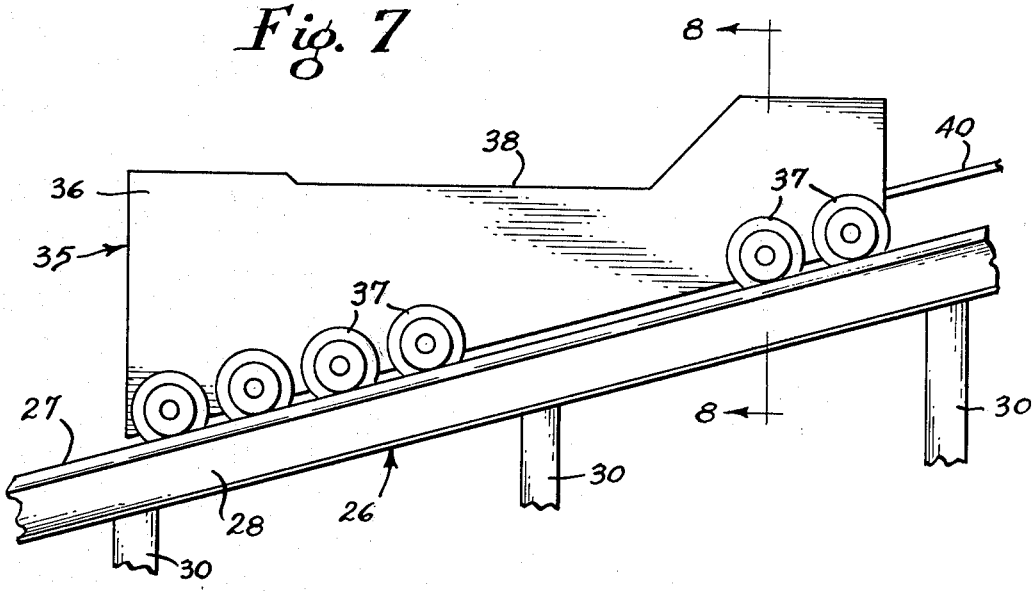
FIG. 7 is an enlarged side elevational view of one of the carriages.
Figure 8:
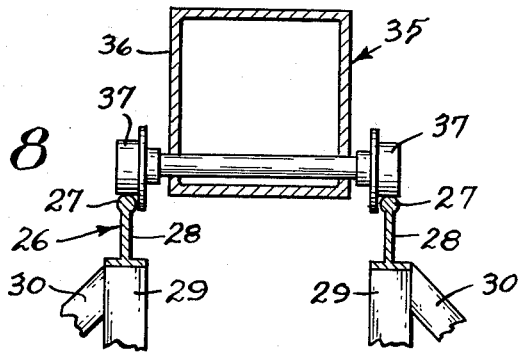
FIG. 8 is a sectional view taken along the line 8—8 of FIG. 7.

With particular reference to FIG. 7, each pair of rails 27 supports a carriage 35 and each carriage includes a body 36 supported by wheels or rollers 37 on the rails 27. The upper portion of each of the carriages 35 may be provided with a recessed portion 38 of a configuration generally complementary to the configuration of the article to be raised, such as the bottom portion of a precast bridge deck unit or bridge section 39. Also, the vessel 10 could be used to raise other vessels out of the water so that repairs to the propeller, rudder, or other damaged structure below the waterline may be carried out without the necessity of putting the damaged vessel in drydock. When another vessel is to be lifted, a cradle (not shown) having a configuration generally complementary to the hull of the other vessel may be attached to the carriages 35 if such cradles are available. If such cradles are not available, the other vessel could be raised by the carriages if care is exercised. If desired, a bridge or connecting member (not shown) could span the gap between the carriages 35 and be connected thereto to form a unitary lift member.

Each of the carriages 35 is connected to a cable 40 which extends over a pulley 41 rotatably mounted at the upper end of the beams 28 and then extends downwardly to a reel 42 mounted on the main deck of each of the outboard portions 14 of the vessel. The reels 42 are mounted on an axle 43 carried by upstanding support members or lugs 44. The reel may be selectively rotated in any desired manner, such as by a driven sprocket or pulley 45 connected by a chain or belt 46 to a drive sprocket or pulley 47 which in turn is driven by a power plant 48.

In order to control the position of the carriages 35 relative to the tracks 26, a telescoping control room 50 is provided and such control room includes a housing 51 which may be raised and lowered as desired. Preferably the apparatus for raising and lowering the housing includes a column or piston rod 52 which is telescopically mounted within a sleeve or fluid cylinder 53 and such cylinder may be provided with fluid under pressure from any desired source (not shown). It is contemplated that the control room 50 could be raised and lowered in any other conventional manner, as by scissors arms or the like (not shown). The control room 50 is mounted on the central portion 13 of the hull and includes space for one or more operators and control panels for controlling operation of the power plants 48, as well as the ballast pump 23 so that the carriages may be raised and lowered as desired and such movement of the carriages may be coordinated with the flooding and exhausting of the compartments 17–22.

With particular reference to FIGS. 9–12 another embodiment of the invention is shown in which the hull 11 of the vessel 10 and the operating mechanisms such as the ballast pump 23, reels 42, power plant 48, and control room 50 remain substantially the same as previously described. In this embodiment the vessel is particularly adapted to raise heavy objects such as barges, containerized crates, heavy equipment, and the like from a dock or wharf or from another floating vessel.

In order to position the vessel 10 adjacent to another structure which supports the load to be lifted above the water, the vessel 10 is provided with an elongated track 55 arranged generally longitudinally of each of the outboard portions 14 and such tracks extend from a position substantially at the bow of the outboard portions to an elevated position abaft the beam of the vessel. Each of the tracks 55 includes a pair of generally parallel beams 56 each having a cross-section similar to an I-beam, H-beam or T-beam which includes a generally horizontal flange 57 integrally connected to a downwardly extending generally vertically disposed web 58. Also it is contemplated that the beams 56 could have a hollow box configuration in cross-section. Each of the beams 56 is supported by upright posts 29 and struts 30 in a manner previously described.

Figure 11:
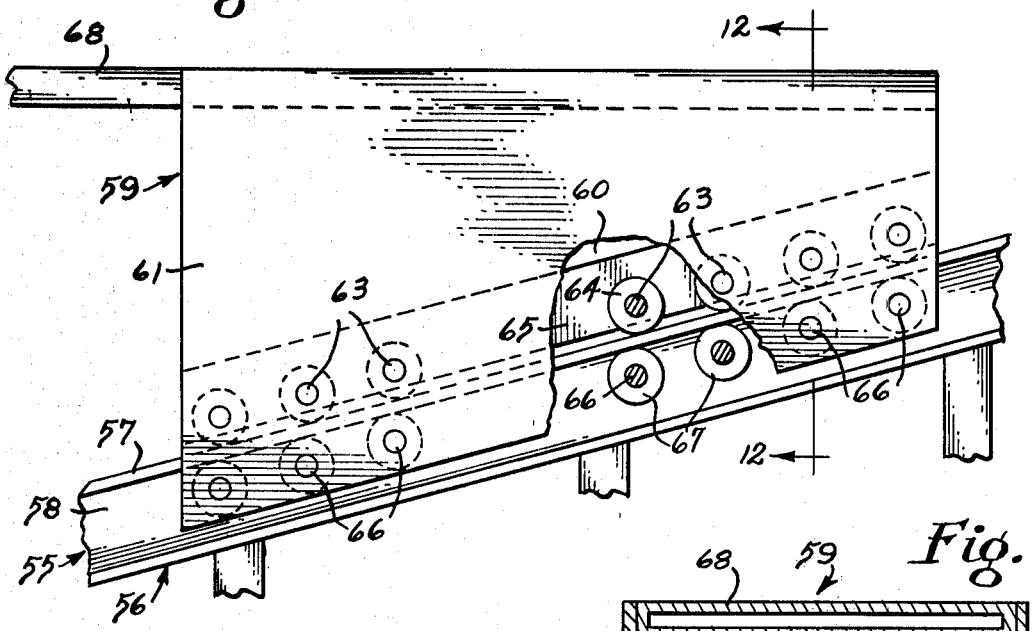
FIG. 11 is an enlarged side elevational view of another embodiment of the carriage.
Figure 12:
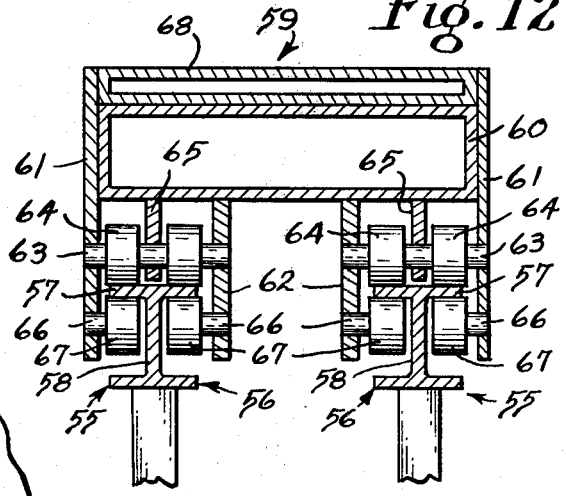
FIG. 12 is a sectional view taken on the line 12—12 of FIG. 11.

With particular reference to FIGS. 11 and 12, each of the tracks 55 supports a carriage 59 including a body 60. As illustrated best in FIG. 12, the body 60 includes a pair of downwardly extending mounting plates 61 and 62 at each side and such mounting plates straddle each of the beams 56. A plurality of upper shafts 63 have opposite ends carried by the mounting plates 61 and 62 and each of such upper shafts rotatably supports one or more rollers 64. It is noted that if desired a single roller could extend between the mounting plates 61 and 62 and bear against the upper surface of the flange 57. However, as illustrated, a pair of rollers 64 are mounted on each of the upper shafts and the shafts are supported by an intermediate support member 65.

A plurality of lower stub shafts 66 are attached to the mounting plates 61 and 62 and each of such lower stub shafts rotatably receives a roller 67 which engages the lower surface of the flange 57. With this construction the rollers 64 and 67 which are located on opposite sides of the flanges 57 substantially prevent up-and-down movement of the carriage but permit longitudinal movement along the beams 56. It is noted that if desired one or more rollers could be mounted on the mounting plates 61 and 62 in such a manner that the rollers bear against the webs 58 of the beams to substantially reduce any side movement of the carriages. In the event that the beams 56 are of box construction, the lower stub shafts 66 will be disposed below the lower surface of the beam so that the rollers 67 engage the lower surface of the beam.

Each of the carriages 59 is provided with an elongated cantilever arm 68 which extends outwardly substantially beyond the carriage body 60 so that it can be received below a palletized article 69 carried by a supporting structure 70 such as a dock, wharf, barge, or the like. When the flooded compartments of the vessel are evacuated and a heavy weight is placed on the outer ends of the arms 68, the weight of the article will tend to cause the carriages 59 to pivot about the forwardmost upper rollers 64; however, the rearmost lower rollers 67 will prevent such pivotal action but will permit the carriages to be raised along the beams 56 by the cables 40 and reels 42.

Figure 9:
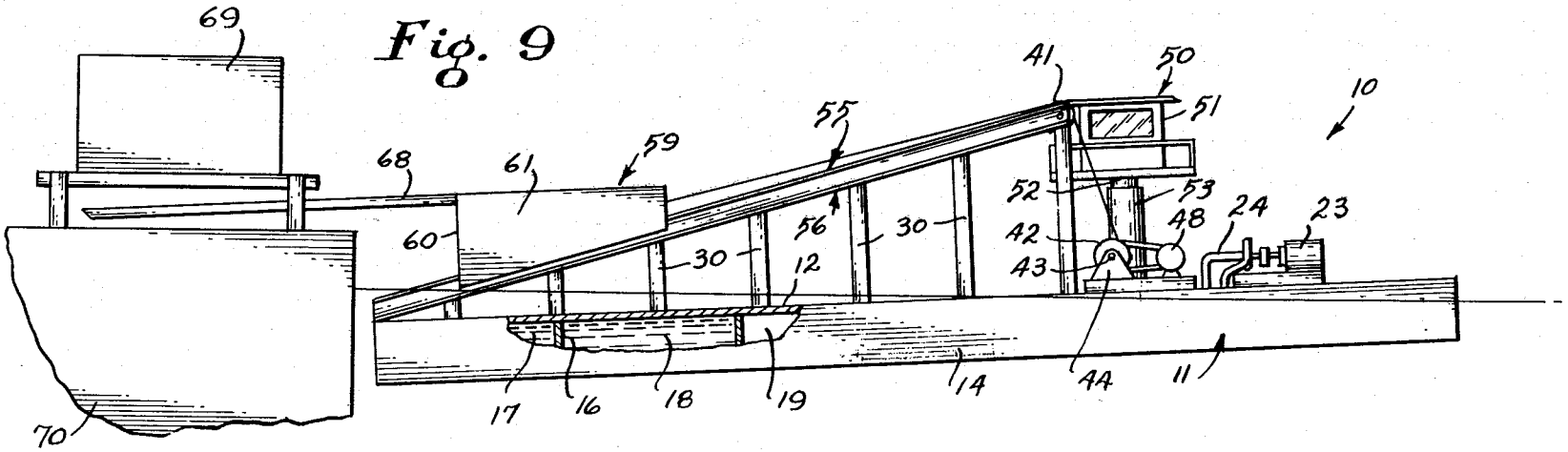
FIG. 9 is a side elevational view illustrating another embodiment of the vessel in a position to raise an object from another structure.
Figure 10:
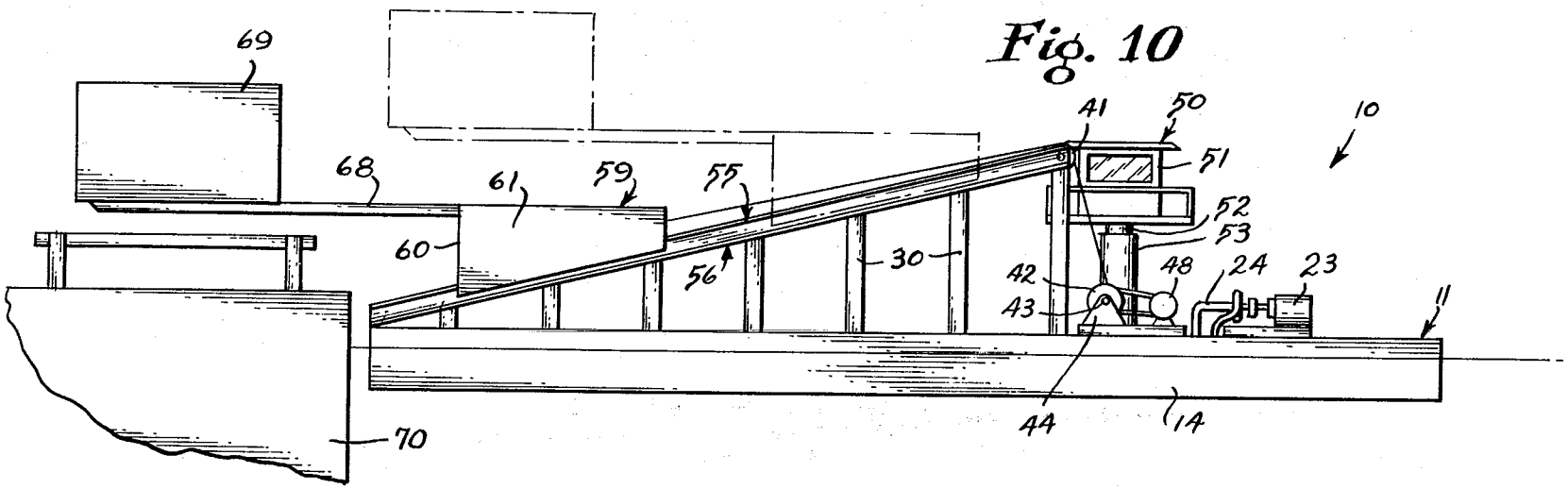
FIG. 10 is a side elevational view similar to FIG. 9 illustrating the position of the vessel after the object has been raised.
Figure 14:
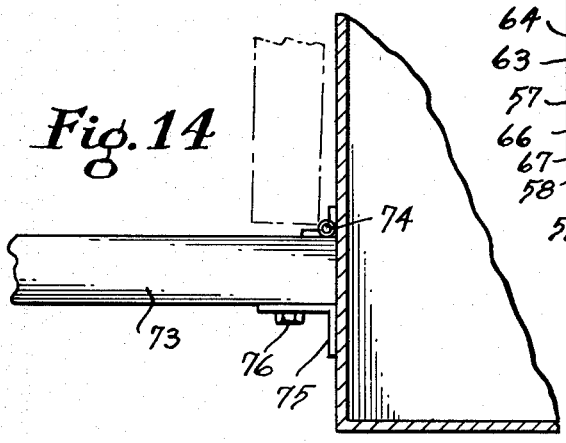
FIG. 14 is a sectional view taken on the line 14—14 of FIG. 13.
Figure 13:
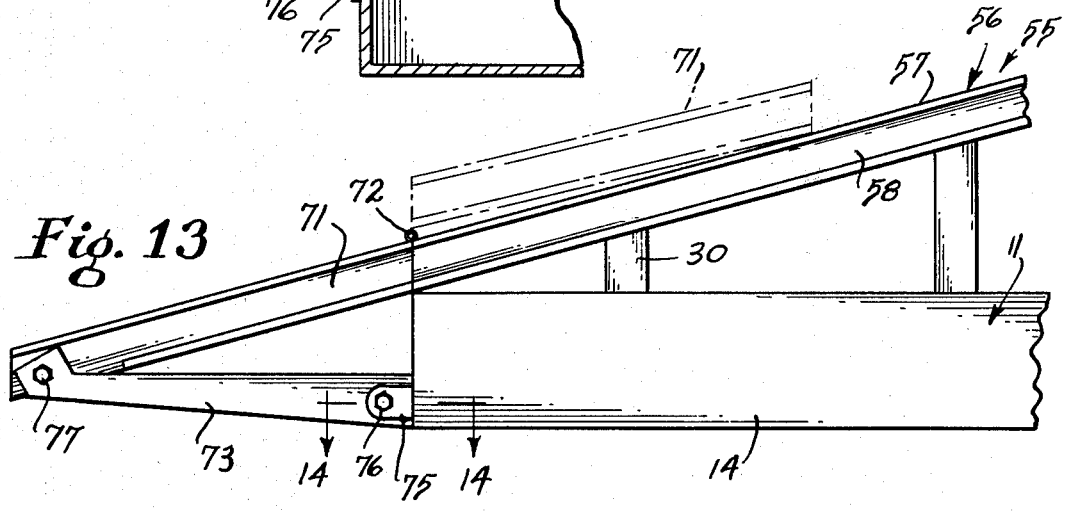
FIG. 13 is a fragmentary side elevational view of a further embodiment of the vessel.

With particular reference to FIGS. 13 and 14, the vessel 10 may have beams 56 which are convertible from the type shown in FIGS. 1 and 3–6 to the type shown in FIGS. 9 and 10. In this construction the beams 56 terminate adjacent to the bow of the outboard portions 14; however, an auxiliary beam 72 may be hingedly mounted on the forward end of the beams 56 by a hinge 72. With this construction the auxiliary beam 71 selectively may be extended forwardly, as illustrated in full lines in FIG. 13, or may be pivoted to a position overlying the main beam 56, as shown in phantom lines. Alternatively the auxiliary beam 71 may be attached in any other conventional manner such as tie plates, socket and pin connections, and the like so that it is in alignment with the main beam 56 when the auxiliary beam is in extended position.

In order to support the auxiliary beam in the extended position, an auxiliary support member 73 is provided and such support member may be connected to the bow of the outboard portion 14 by a hinge 74 located at one side of the support member. With this construction the auxiliary support member 73 may be folded or pivoted against the bow of the vessel when not in use. At the opposite side of the auxiliary support member 73, an angle tie plate 75 is provided which has a first portion welded or otherwise attached to the outboard portion 14 of the vessel. In order to secure the auxiliary support member in outwardly extending position, a bolt or other fastener 76 is provided which extends through the angle tie plate 75 and is threadedly received by the support member. The outer end of the auxiliary support member may be attached to the outer end of the auxiliary beam 71 by a bolt or other fastener 77 when the auxiliary beam is in an extended position. If desired, the auxiliary support member may be removably mounted in any other conventional manner, such as being slidably received within a socket located within the hull 11.

The vessel 10 may be non-self-propelled in which case one or more tugboats or other work vessels may push the vessel 10 to a position to engage and lift a relatively heavy object, after which the vessel 10 is moved to a position such that the article may be discharged therefrom. On the other hand, it is contemplated that the central portion 13 of the vessel could be provided with a propulsion power plant as well as one or more rudders for steering so that the vessel may be propelled in a forward or rearward direction and steered in a conventional manner.

If the vessel is self-propelled, it is contemplated that the vessel could have bow thrusters including an auxiliary power plant located adjacent to the bow of the vessel and provided with a propeller shaft and propeller located athwartship to increase the control and maneuverability of the vessel.

Although the vessel 10 may be of any desired size, a suitable size for lifting bridge sections and other heavy objects such as boats, large containerized crates, barges, and the like up to 120 feet (36.58 meters) in length and weighing 500 tons (453.6 metric tons), includes a pair of outboard portions or bifurcations 14 each of which is approximately 120 feet (36.58 meters) in length and 30 feet (9.14 meters) in width and a central portion 13 which is approximately 50 feet (15.24 meters) in length and 20 feet (6.07 meters) in width. Each of the outboard and central portions of the vessel has a depth of approximately 7-½ feet (2.29 meters). The compartments 17–22 may be of any desired size, however, equally spaced compartments which are approximately 20 feet (6.07 meters) in length and 30 feet (9.14 meters) in width are preferred.

Figure 3:
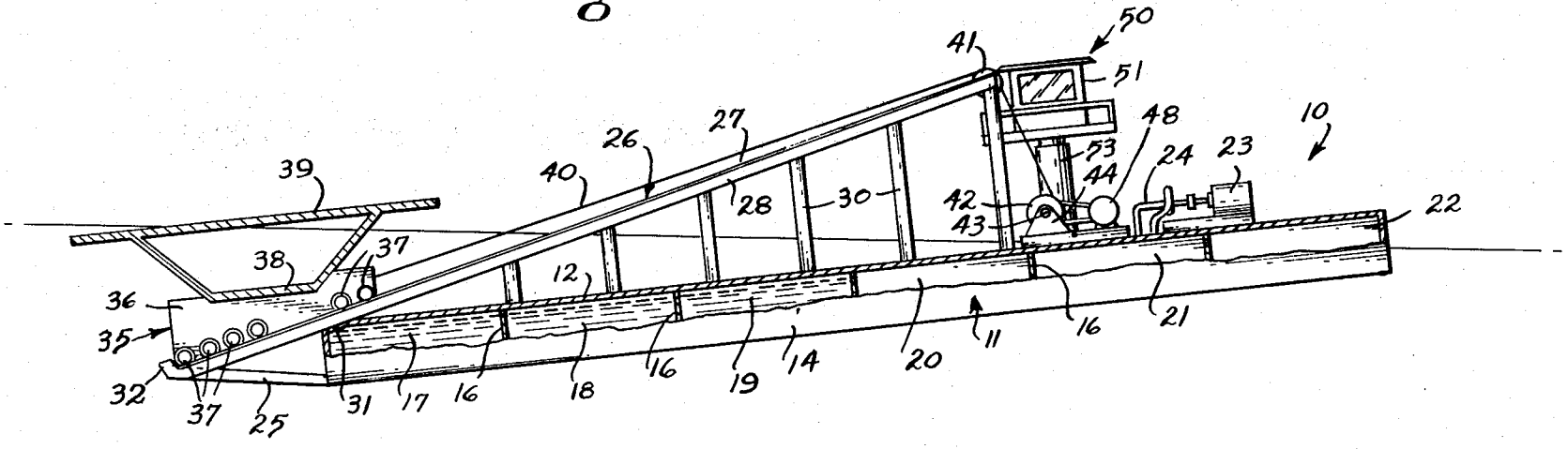
FIG. 3 is a side elevational view illustrating the vessel having its forward tanks flooded and with the carriages located below a floating object to be raised.
Figure 4:
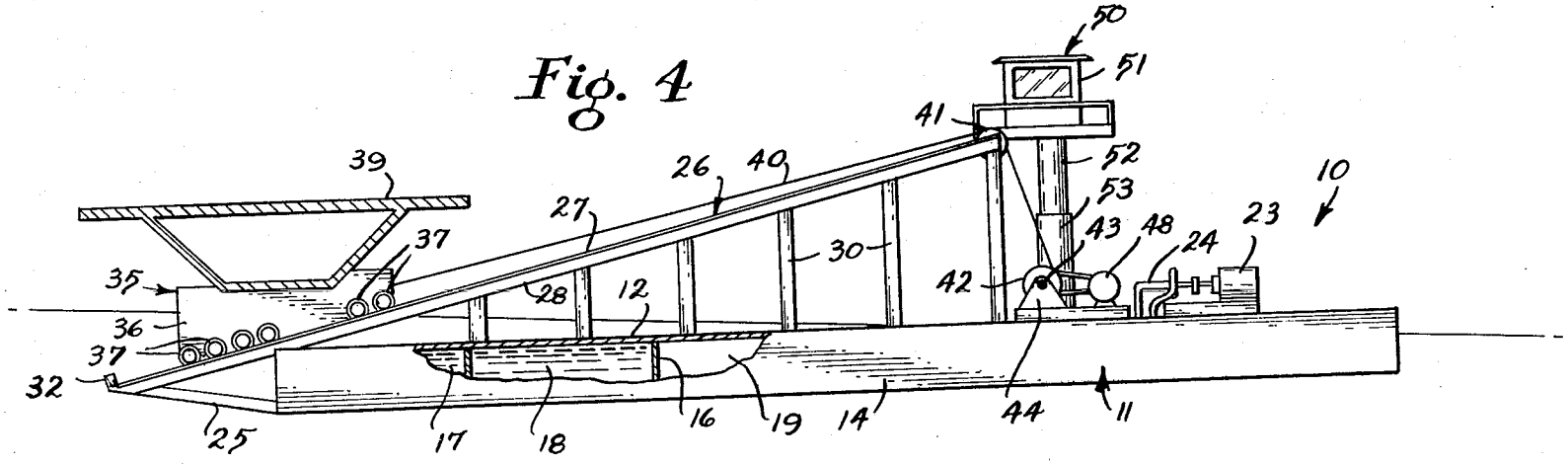
FIG. 4 is a side elevational view similar to FIG. 3 illustrating the position of the vessel after the tanks have been partially evacuated and the carriages have lifted the object out of the water.
Figure 5:
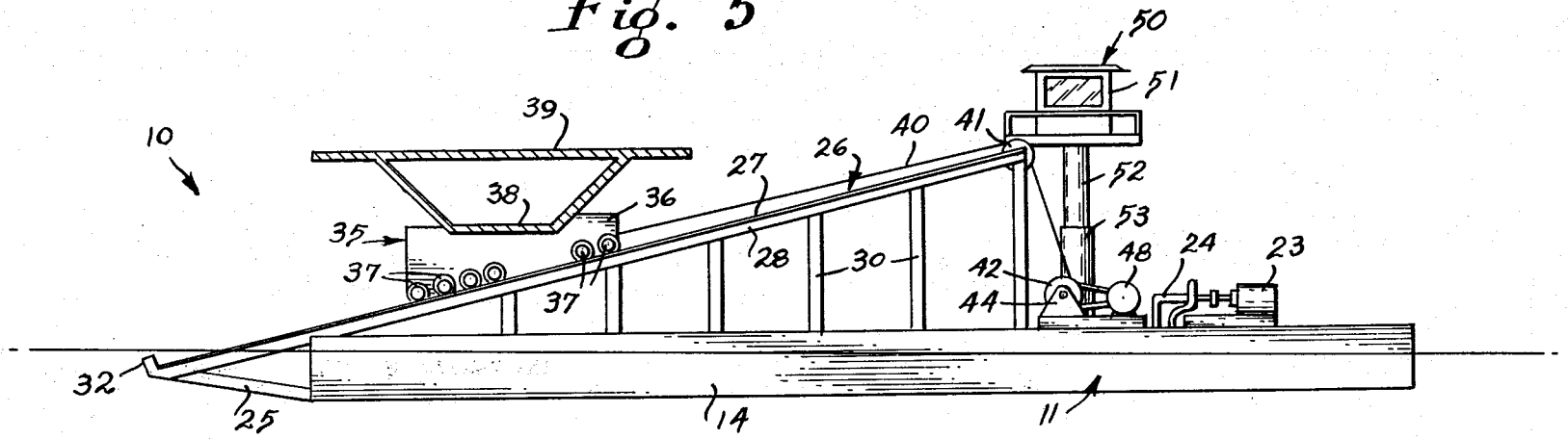
FIG. 5 is a side elevational view similar to FIG. 3 illustrating the position of the hull of the vessel after the water in the tanks has been substantially evacuated.

In the operation of the device, when the vessel is to be used in the building of bridges or replacing of bridge sections, the vessel is moved to a position generally normal to the center of gravity of a bridge section 39 which is floating in the water or is supported by one or more barges and then the forward compartments 17, 18 and 19 of the outboard portions of the hull 11 are flooded so that the bow portion of the vessel is submerged. The carriages 35 are lowered until such carriages are disposed directly below the bridge section and in proximity thereto. In this position the water is pumped out of the compartments 17, 18 and 19 to provide more buoyancy for the bow of the vessel so that the bow rises until the carriages 35 engage the bottom portion of the bridge section and at least partially raise the bridge section out of the water or off of the barges. During this operation the control room 50 preferably is in the lowermost position, as illustrated in FIG. 3, so that the operator will have a clearer view of the proceedings. After the bridge section has been partially raised, the control room 50 is extended to the uppermost position, as shown in FIG. 4, and the power plants 48 are operated to wind the cables 40 onto the reels 42 to cause the carriages 35 to raise the bridge section along the inclined track 26 until the bridge section is substantially clear of the water.

During the raising of the bridge section, the operator may transfer water from the forward compartments to the aft compartment 22, or water from the surrounding body of water may be introduced directly into the aft compartment in a desired amount to trim the vessel and counterbalance the weight of the bridge section. With the bridge section in an intermediate position, the vessel 10 is moved to a location adjacent to a bridge pier and aligned with such pier so that forward movement of the vessel causes the outboard portions or bifurcations of the vessel to straddle the pier.

Figure 6:
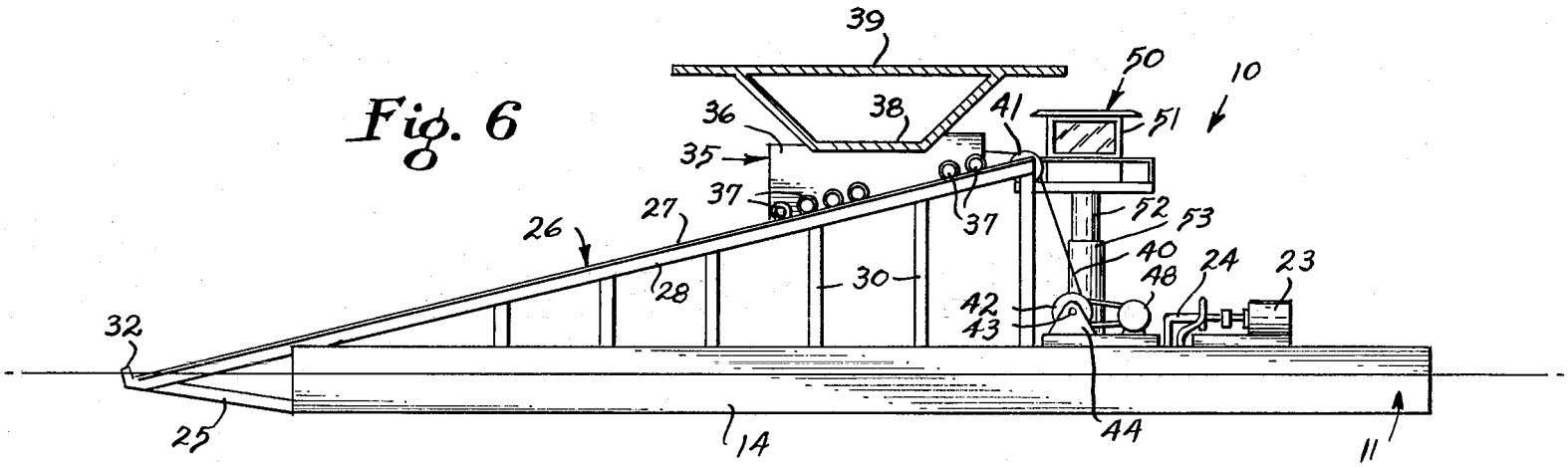
FIG. 6 is a side elevational view similar to FIG. 3 illustrating the position of the object after it has been raised to its uppermost position.

During this operation, the power plants 48 are operated to raise the bridge section 39 to an elevation slightly higher than the top of the bridge pier and the control room 50 may be lowered, as illustrated in FIG. 6, so that the operator can judge the relative spacing between the bottom of the bridge section and the top of the pier. The vessel then is moved forwardly until the bridge section is disposed immediately above the pier and the bridge section is in longitudinal alignment with one or more adjacent bridge sections. In this position water is introduced into the appropriate compartments to cause the vessel to become less buoyant and thereby lower the bridge section onto the pier. The vessel may stabilize the bridge section on the pier until the bridge section is connected to adjacent sections, after which more water is introduced into the forward compartments to disengage the bridge section from the carriages 35.

When the vessel is to be used to lift heavy objects from a supporting structure located above the water (FIGS. 9–14), the forward portion of the inclined tracks may be omitted or may be selectively removable so that the bow of the vessel 10 may be moved to a position contiguous to the supporting structure. As the vessel approaches the supporting structure, the carriages 59 are lowered so that the cantilever arms 68 extend beyond the bow of the vessel and the forward compartments are flooded to decrease the buoyancy of the bow portion of the vessel. In this position, the vessel 10 is moved forwardly so that the arms 68 are disposed below the object after which the forward tanks are evacuated to provide sufficient buoyancy to raise the object off of the supporting structure.

When the vessel is self-propelled, the hull of the central portion 13 serves as an engine room for the machinery of the vessel. However, when the vessel is non-self-propelled, the hull of the central portion may be divided into additional watertight compartments which may be selectively flooded or pumped dry in the same manner as the compartments in the outboard portions 14.

Although the vessel of the present invention, which is illustrated in FIGS. 1–8, has been described for use with a floating bridge unit, it is recognized that bridge deck units or bridge sections may be transported to the site by at least two spaced apart barges. In this case, the vessel 10 is moved between the barges and the bow portion of the vessel 10 may be partially flooded to permit the carriages 35 to be located below the bridge unit after which the water is exhausted from the vessel 10 so that the carriages lift the bridge unit off of the barges. If the bridge section is being supported by a single barge, the structure which is illustrated and described with reference to FIGS. 9–14 may be used to remove the bridge section.

In cases where the opposite ends of a bridge section are to be placed on piers with the central portion of such section being unsupported, the vessel is moved to a position between the piers and is maneuvered to a location such that opposite ends of the bridge section are directly above the corresponding piers. To assist in positioning the bridge section, it is contemplated that the power plants 48 may be operated independently so that the bridge section may be jockeyed into position. Also, since the pier at one end of the bridge section may be at a different elevation than the pier at the opposite end, the compartments of the outboard portions 14 may be independently flooded and pumped dry to cause the vessel to list to a desired side.

I claim:

1. Apparatus for installing a preformed bridge unit on at least one bridge pier, comprising a marine vessel having a buoyant bifurcated hull with a main deck, a pair of spaced generally parallel track means mounted longitudinally on said hull, one of said track means being mounted on each bifurcation of said hull, support means mounting each of said track means on an incline so that the forward end of each track means extends beyond the bow of said vessel and below said main deck, the rearward end of each track means extending above the vessel to a height sufficient to position said bridge unit above said bridge pier, carriage means movably mounted on each track means for engaging and supporting said bridge unit in spaced locations, means for moving said carriage means independently from a lowermost position on said track means to an elevated position in which said bridge unit is located at a higher elevation than said bridge pier, said hull including a plurality of watertight compartments which selectively receive water as a ballast, means for adding water to certain of said compartments to cause the bow portion of said vessel to be at least partially submerged so that portions of said carriage means may be positioned below said bridge unit when said bridge unit is in a lowermost position and removing at least part of the water from said certain compartments to increase the buoyancy of the bow portion of said hull to support said bridge unit on said carriage means.

2. The method of mounting a bridge unit on at least one pier, comprising the steps of moving said bridge unit to a position near the pier, submerging one end of a buoyant member having inclined track means having carriage means thereon so that said carriage means is located beneath said bridge unit, raising said submerged end so that said carriage means engages said bridge unit, elevating said carriage means with the bridge unit thereon upwardly on said track means above the water level, transporting said track means with the bridge unit thereon to a position adjacent to the bridge pier, raising said bridge unit to an elevation above the bridge pier, moving said track means to a position in which said bridge unit is in vertical alignment with the bridge pier, and lowering the bridge unit onto the pier.

3. The method of claim 2, including the step of raising said one end to bring the floating inclined track means to level position in the water as the carriage means is elevated.

4. A marine vessel for lifting and elevating heavy objects relative to the surface of a body of water comprising a buoyant hull having first and second ends, a main deck, said hull having a plurality of compartments for receiving ballast, means for selectively introducing ballast into and removing ballast from said compartments to selectively raise and lower said first end of said hull relative to the surface of the body of water so as to lower a portion of said main deck to a point adjacent to the surface of the body of water, track means mounted so as to extend longitudinally of said hull, said track means having a first end dispose generally adjacent said main deck so as to be be disposed generally adjacent to the surface of the body of water when said first end of said hull is lowered thereby lowering said portion of said main deck with respect to the surface of the body of water and a second end disposed in a remote vertically spaced relationship to and above said main deck and vertically spaced above the surface of the body of water, support means mounting said track means on an incline with said first end of said track means being located generally adjacent said first end of said hull and said second end of said track means being remotely spaced longitudinally from said first end toward said second end of said hull, carriage means movably mounted on said track means, said carriage means having engaging means for cooperatively supporting the heavy objects, and means for moving said carriage means along said track means to raise or lower said carriage means with respect to said main deck and the surface of the body of water.

5. The invention of claim 4 including at least two spaced and generally parallel track means, a carriage means movably mounted on each of said track means and a means for moving said carriage means being independently connected to each of said carriage means.

6. The invention of claim 4 in which said hull includes bifurcations which extend inwardly from said first end of said hull thereby leaving an open space between said bifurcations and at least one of said track means being mounted to each of said bifurcations.

7. The invention of claim 6 in which each of said track means include a pair of generally parallel rail members and said carriage means including at least two sets of spaced roller means, one set of said roller means mounted in engagement above and below each of said rail members.

8. The invention of claim 5 in which each of said first ends of said track means extends beyond said first end of said hull and generally below said main deck.

9. The invention of claim 8 including a support member attached to said first end of said hull and extending outwardly therefrom and supporting the end of said track means which extends beyond said first end of said hull.

10. The invention of claim 4 in which said first end of said track means terminates at said first end of said hull.

11. The invention of claim 10 including an auxiliary track means which is selectively alignable with said first end of said track means and extends beyond said first end of said hull when aligned with said first end of said track means.

12. The invention of claim 4 including a vertically adjustable control room mounted on said hull, said control room containing apparatus for controlling said means for moving said carriage means and said means for introducing the ballast.

13. The invention of claim 4 in which said carriage means includes a pair of spaced cantilever arms disposed generally parallel with the main deck and which extend beyond said first end of said vessel when said carriage means is disposed adjacent said first end of said hull.

* * * * *